US009404052B2

(12) United States Patent
Flores Oropeza et al.

(10) Patent No.: US 9,404,052 B2
(45) Date of Patent: Aug. 2, 2016

(54) DEHYDRATING AND DESALTING MEDIAN, HEAVY AND EXTRA-HEAVY OILS USING IONIC LIQUIDS AND THEIR FORMULATIONS

(75) Inventors: Eugenio Alejandro Flores Oropeza, Mexico City (MX); Laura Verónica Castro Sotelo, Mexico City (MX); Alfonso López Ortega, Mexico City (MX); José Gonzalo Hernández Cortez, Mexico City (MX); Fernando Alvarez Ramírez, Mexico City (MX); Flavio Salvador Vázquez Moreno, Mexico City (MX); Arquímedes Estrada Martínez, Mexico City (MX); Marcelo Lozada Y Cassou, Mexico City (MX)

(73) Assignee: INSTITUTO MEXICANO DEL PETROLEO, Mexico City (MX)

( * ) Notice: Subject to any disclaimer, the term of this patent is extended or adjusted under 35 U.S.C. 154(b) by 127 days.

(21) Appl. No.: 13/443,662

(22) Filed: Apr. 10, 2012

(65) Prior Publication Data

US 2012/0255886 A1 Oct. 11, 2012

(30) Foreign Application Priority Data

Apr. 11, 2011 (MX) ..... MX/A/2011/003848

(51) Int. Cl.

| | |
|---|---|
| ***C10G 33/04*** | (2006.01) |
| ***C10G 31/08*** | (2006.01) |
| ***C10G 21/08*** | (2006.01) |

(52) U.S. Cl.

CPC ..... *C10G 33/04* (2013.01); *C10G 21/08* (2013.01); *C10G 31/08* (2013.01); *C10G 2300/1033* (2013.01); *C10G 2300/308* (2013.01); *C10G 2300/44* (2013.01)

(58) Field of Classification Search

CPC ..... C10G 31/08; C10G 33/04
USPC ..... 208/187, 188, 251 R, 298
See application file for complete search history.

(56) References Cited

U.S. PATENT DOCUMENTS

| | | | | |
|---|---|---|---|---|
| 5,248,449 | A * | 9/1993 | Mitchell et al. | 516/150 |
| 5,609,794 | A | 3/1997 | Taylor | |
| 2010/0051509 | A1 | 3/2010 | Martinez Palou et al. | |
| 2011/0186515 | A1* | 8/2011 | Guimaraes et al. | 210/643 |

FOREIGN PATENT DOCUMENTS

| | | |
|---|---|---|
| WO | 2006/111712 | 10/2006 |
| WO | 2006/116175 | 11/2006 |
| WO | 2008/124042 | 10/2008 |
| WO | 2009/023724 | 2/2009 |
| WO | 2009/097061 | 8/2009 |

OTHER PUBLICATIONS

Guzman-Lucero, Diego et al., Ionic Liquids as Demulsifiers of Water-in-Crude Oil Emulsions: Study of the Microwave Effect, Energy & Fuels, vol. 24, Jun. 2010, pp. 3610-3615.*

Lemos, Rita C. B. et al., Demulsification of Water-in-Crude Oil Emulsions Using Ionic Liquids and Microwave Irradiation, Energy & Fuels, vol. 24, Aug. 2010, pp. 4439-4444.*

Jose-Alberto, Murillo-Hernandez et. al., Current Knowledge and Potential Applications of Ionic Liquids in the Petroleum Industry, Ionic Liquids: Applications and Perspectives, Feb. 2011, pp. 439-458.*

* cited by examiner

*Primary Examiner* — Renee E Robinson
(74) *Attorney, Agent, or Firm* — Dickinson Wright PLLC

(57) ABSTRACT

The present invention relates to the application of ionic liquids individually or in formulation to dry and desalt crudes oils having API gravities in the range of 8 to 20 (median, heavy and extra-heavy) when applied at concentrations ranging from 500 and up to 5000 ppm. The ionic liquids have a cation consisting of quaternary ammonium, wherein the substituents R, $R_1$ and $R_2$ are independent radicals represented by alkyl chains including 2 to 8 carbon atoms; and anion selected from the group consisting of ethylsulfate, methylsulfate and chloride.

17 Claims, 12 Drawing Sheets

Figure 1:
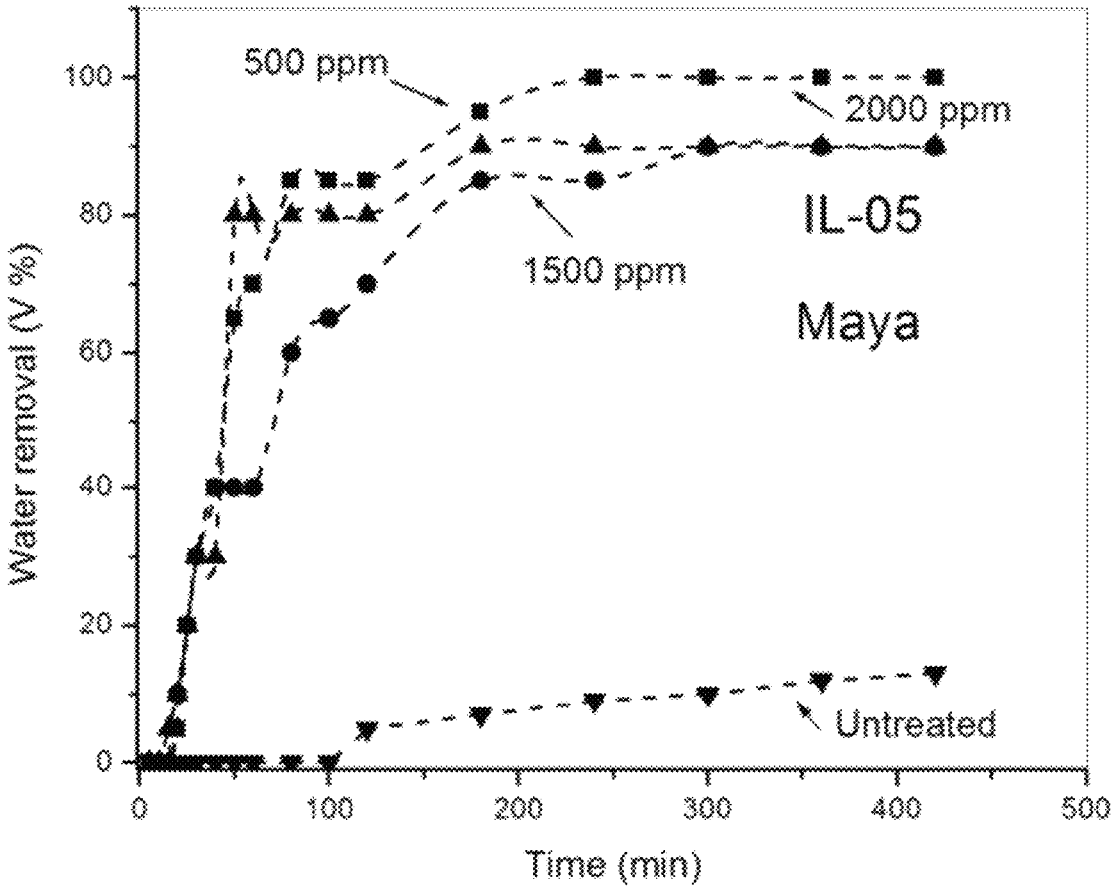

DEHYDRATING AND DESALTING MEDIAN, HEAVY AND EXTRA-HEAVY OILS USING IONIC LIQUIDS AND THEIR FORMULATIONS

CROSS-REFERENCE TO RELATED APPLICATION

This application claims the benefit under 35 U.S.C. §119 of Mexican Patent Application No. MX/a/2011/003848, filed Apr. 11, 2011, which is hereby incorporated by reference in its entirety.

FIELD OF THE INVENTION

This invention is related to dehydration and desalting of crude median, heavy and extra heavy oils, using ionic liquids (IL's) individually and/or formulation.

BACKGROUND OF THE INVENTION

Crude oil produced from wells located offshore and in inland areas, is emulsified with different proportions of water. The percentage of water also varies greatly during the production history of wells. Because of their molecular characteristics, oil and water are immiscible, but when oil is produced, it is inevitable the simultaneous production of water. Once production begins, both oil and water are transported to storage tanks through pipelines, power applied it generates turbulence which promotes the mixing of both phases leading to different emulsion of water/oil, oil/water, water/oil/water and oil/water/oil, such emulsions can become very stable and are favored by emulsifying compounds (asphaltenes, carboxylic acids, resins and clays) naturally present in crude oil. The stability emulsions depend largely on the composition of crude oil (Hellberg P E et al 2007).

The emulsified water in oil, containing carbonates and sulphates of sodium, magnesium and calcium, which if not are removed, can cause various problems in subsequent refining processes. The proportion of water in oil has a ceiling of 0.5% and a salt content of less than 50 mg/L, so that the first unit operation to be performed in the petroleum refining, is the removal of water and therefore of the salts that it contains.

Initially crude desalting was done as a preventive measure to reduce corrosion, but in recent years desalination technology has become more important, it helps also to protect the catalysts used in later stages of the refining process. (Xu X et al 2006).

Therefore, from the operational point of view and mainly economic, it is imperative and important to separate water from oil, as completely and as quickly as possible in the same production site. To achieve this goal batteries have been used in for separation, physical and chemical methods, independently or sequentially. (Hellberg PE et al 2007).

The chemical removal of water consists of the addition of small amounts of demulsifiers (1 to 1000 ppm) to crude oil stored in tanks of separation, just before being pumped, to break the emulsion water in oil (Spinelli LS et al 2007).

The demulsifiers most often used today in the oil industry are resins of the type alkyl-formaldehyde, copolymers of propylene polyoxide-polyethylene oxide, alkoxylated amines, alkoxylated epoxy resins, dissolved in one or more solvents such as xylenes, toluene, gasoline and short chain alcohols. Its mechanism of action promotes the coalescence of small droplets of water in large droplets, which then flocculate thus leading to the separation of both phases. It has also been established that the role of a good demulsifier is to alter the rheological properties of interfacial layer and destabilize the oil layer endogenous emulsifier. Usually commercial demulsifiers are a mixture of several components with different polymer structures, as well as a wide range of molecular weights. (Al-Sabagh AM et al 2002).

As important examples in the literature which mention the use of demulsifiers to break the emulsion water in oil, in the oil industry may be mentioned the following international references:

Adducts (esters and amides) of oleic acid-maleic anhydride have been used (1) in demulsification of crude oil (API=41) which water content varies from (1)

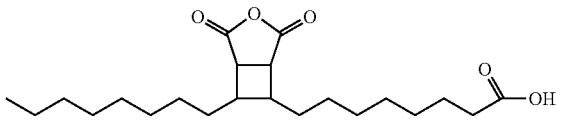

Adducts of oleic acid-maleic anhydride

10% to 30%: obtaining water removals near 100% at concentrations of 200 ppm at temperatures above 40° C. (Al-Sabagh A M et al 2002). International Patent WO 2009/097061 A1 describes the use of different demulsifiers such as those shown below (2):

R—O—(XO)a-(YO)b-(ZO)c-H (I)

R2—O-Jp-O-(XO)a-H (II)

R—O—(CH2-CH(CH2(BO)d)-O)a-(CH2-CH(CH3)-O)b-(CH2-CH(CH2(BO)d)-O)c-H (III)

(2) Demulsifiers of the international patent application WO 2009/097061 A1 where R can be H, alkyl-($C_1$-$C_{30}$)-phenol, dialkyl-($C_1$-$C_{30}$)-phenol, alkoxylated polyamine and/or an alcohol or polyol; X, Y, Z and B represent alkyl residues of methylene, ethylene, propylene, 3-hydroxypropylene, butylene, phenylene, and mixtures thereof; a, b, c and d are independent numbers representing from 1 to 500 units of ethylene oxide, oxide of 3-hydroxy-propylene and mixtures of them, $R_2$ is a linear or branched alkyl radical, saturated or unsaturated, J is a radical oligocosile, so that the demulsifiers containing at least 70% by weight of ethylene oxide and/or oxide of 3-hydroxy propylene. The above mentioned demulsifiers were also modified with: alcohols, aliphatic and aromatic anhydrides, alkyl and benzyl halides, carboxylic acids and isocyanates among some other functional groups, including polymerizable monomers; these modified demulsifiers were applied in a range of concentrations ranging from 1 to 1000 ppm and temperature from 60° C. to 150° C. in crudes which API gravity hovers around 20 and containing connate water or in crude oil to which was added wash water. (Patel N et al 2009).

WO 2009/023724 discloses a set of formulations composed of one or more anionic surfactants, and one or more non ionic surfactants. The anionic surfactants are comprised of anionic alkylsulfosuccinates, alkylphosphonic acids and their salts and any combinations of them; the non ionic surfactants are selected from the group of copolymers of polyethylene oxide/polypropylene oxide, ethoxylated fatty acid of polyethylene glycol, modified alkanolamides and alkoxylated terpenes (FIG. 3), alone or in combinations thereof. The formulations described above were tested in concentration ranges from 1 to 2000 ppm, in periods of 30 minutes at room temperature, indicating that achieve 100% removal, but without stating what kind of oil is applied. (Talingting-Pabalan R et al 2009)

(3)

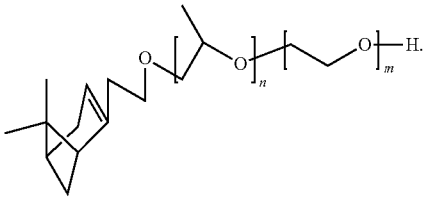

Alkoxylated pinene

WO 2006/116175 discloses use of a demulsifier composition prepared by the reaction of alkyl phenol resins, formaldehyde or one or more polyalkyleneglycols or mixing them, with various phosphorus compounds selected from the group that comprises phosphorus oxychloride, phosphorus pentoxide and phosphoric acid in a molar ratio from 0.001 to 1.0. The addition of the demulsifier composition was held from 50 to 500 ppm in crude oils with API gravity equal to 15 (Myers C et al 2006).

U.S. Pat. No. 5,609,794 discloses the use of an adduct of polyalkylene glycol and ethylene oxide, which is esterified with an anhydride to form the diester, which is then reacted with vinyl monomers and so on, to form different esters: the formulations were applied in a temperature range from 7° C. up 80° C. in concentrations ranging from 10 to 1500 ppm and were applied to oil (unspecified) and different currents (jet fuel, gasoline, lubricating oils and others). It is mentioned that the separated water reaches 40% in volume within several minutes, without specifying how many (Taylor G N 1997).

On the other hand, ionic liquids (IL's) have been used in various applications in the pharmaceutical, petrochemical and chemical industries. The IL's are materials which are ionic liquid phase in the temperature range between 0 and 100° C., and because they are composed mainly of ions. The IL's have low vapor pressures, thereby reducing the risk of air pollution (Collins I R et al 2006).

The IL's have been applied in the oil industry for different purposes, as described below:

IL's the type octylsulfate butyl-methyl-imidazolium and ethylsulfate ethyl-methyl-imidazolium have desulfurized current refineries as well diesel and gasoline from FCC. The yields obtained vary between 95 and 99% when applied to synthetic diesel, using the IL's before mentioned in 5 successive extractions. Their mode of action involves the selective extraction of aromatic compounds such as dibenzothiophene, which is very difficult to remove in the process HDS (hydrodesulfurization), including the authors propose this methodology as a viable alternative to HDS process (Esser J et al 2004).

The IL's also have been used as lubricants (4) in aircraft, in addition withstand temperatures above 415° C. (Canter N. 2007).

(4)

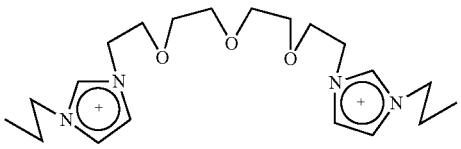

-continued

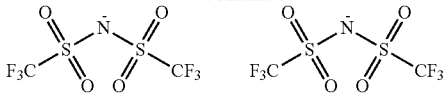

Ionic liquid dicationic

WO 2008/124042 discloses the use of IL's type quaternary ammonium, phosphonium, pyridinium, imidazolium, tetrazolium and triazolium salts with a wide variety of anions as sulfate, phosphate, alkylsulfonate, alkylphosphate, chloroaluminates among others, to selectively extract resins, polyaromatics and heterocyclic compounds with high molecular weight from bitumen, vacuum residues and heavy oils, in a ratio IL: crude oil (1:5) at temperature ranges between 50° C. and 225° C., to increase API gravity of these currents (Siskin M, et al 2008).

The IL's also have been used to selectively extract diesel basic nitrides, e.g. chloroaluminate of 1-butyl-3-methyl-imidazolium extracted with 97% efficiency, using a weight ratio of IL's/diesel=0.03 at a temperature of 50° C. for 3 minutes (Peng G, et al 2005).

The simultaneous application of IL's and microwave energy have been used to promote the breakdown of water emulsions in crude oil, it considers the use of microwaves as a heating source that accelerates and increases the efficiency of the demulsification, this treatment was applied to crude oils with API gravities between 21 and 30 (Rojo T 2009, Guzmán-Lucero D J et al 2010).

Considering the operating conditions of the management of oil and its value in international markets, is of paramount importance to break the water/oil emulsions to remove the water dispersed while the crude oil desalting. The water removal means to produce oil with the required quality for export and/or refining, it also means reducing corrosion in oil installations and the poisoning of the catalysts used during processing.

Considering the above, we proceeded to make demulsifiers formulations based IL's, for treatment of medium, heavy and extra heavy crude oil, since none of the references mentioned above claim the employment of formulations containing them, with similar or better efficiencies demulsifiers and dehydrating over medium, heavy and extra heavy crude oils, which API gravities are between 8 and 20.

BRIEF DESCRIPTION OF THE DRAWINGS OF THE INVENTION

A brief description of the drawings contained in the present invention:

FIG. 1. Graph showing the evaluation at 80° C. in Maya crude oil (API=19.1) of the IL-05 (trihexylmethylammonium methylsulfate) at different concentrations.

Figure 2:
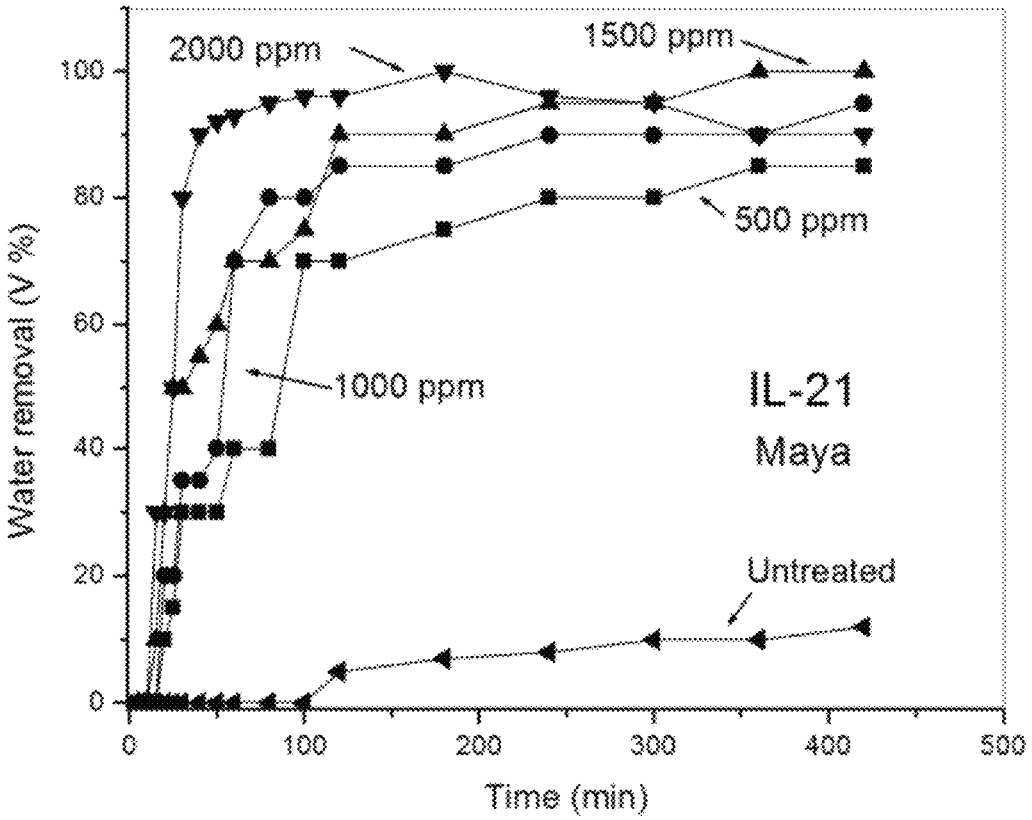

FIG. 2. Graph showing the evaluation at 80° C. in Maya crude oil (API=19.1) of the IL-21 (trioctylmethylammonium chloride) at different concentrations.

Figure 3:
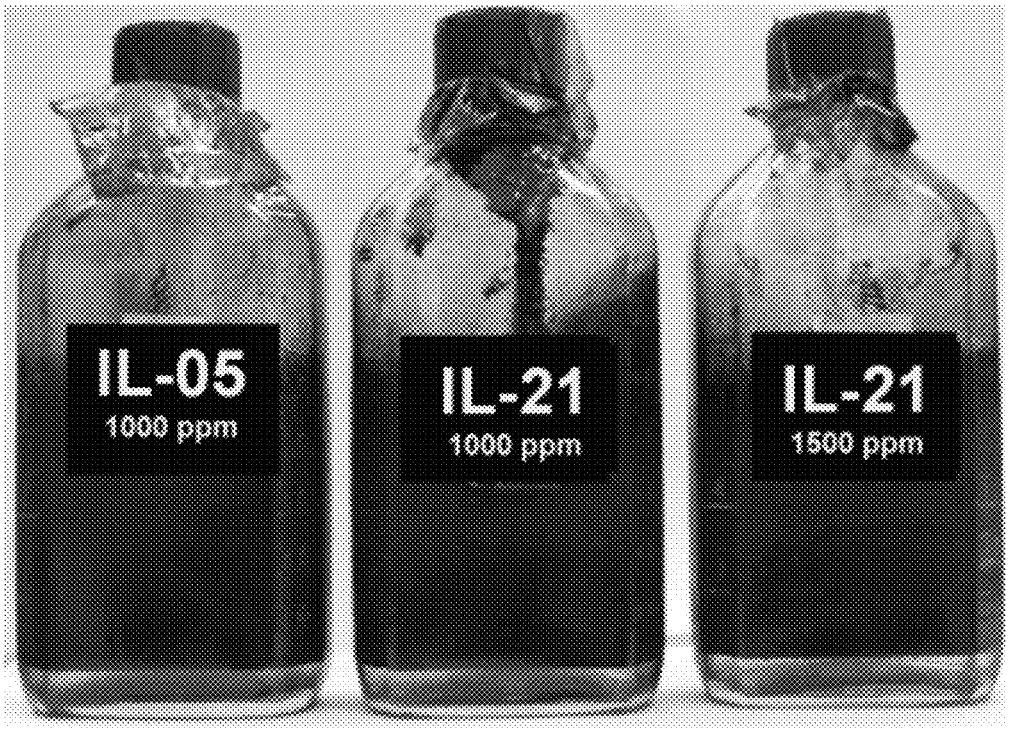

FIG. 3. Photograph showing that ionic liquids 05 and 21 fully break water/oil emulsion in Maya crude oil (API=19.1) at 80° C.

Figure 4:
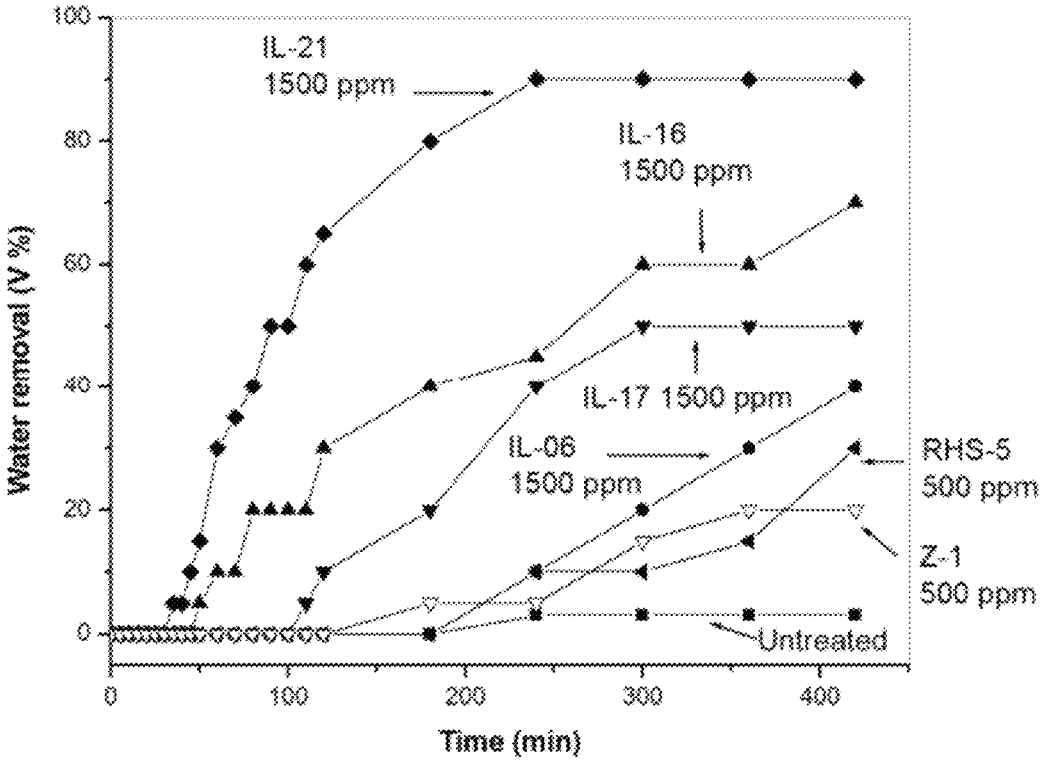

FIG. 4. Graph showing the evaluation at 80° C. in M+T crude oil (API=17.1) of the IL's 6, 16, 17, 21, the formulation IMP-RHS-5 and Z-1 copolymer.

Figure 5:
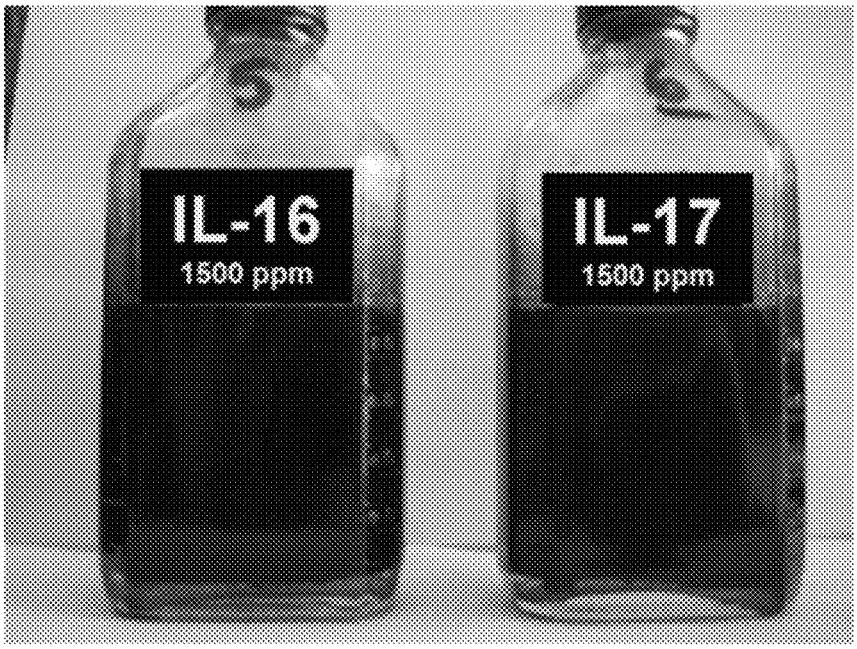

FIG. 5. Photograph showing that ionic liquids IL-16 (trioctylmethylammonium ethylsulfate) and IL-17 (trioctylmethylammonium methylsulfate) perfectly remove water in emulsion M+T crude oil (API=17.1) at 80° C.

Figure 6:
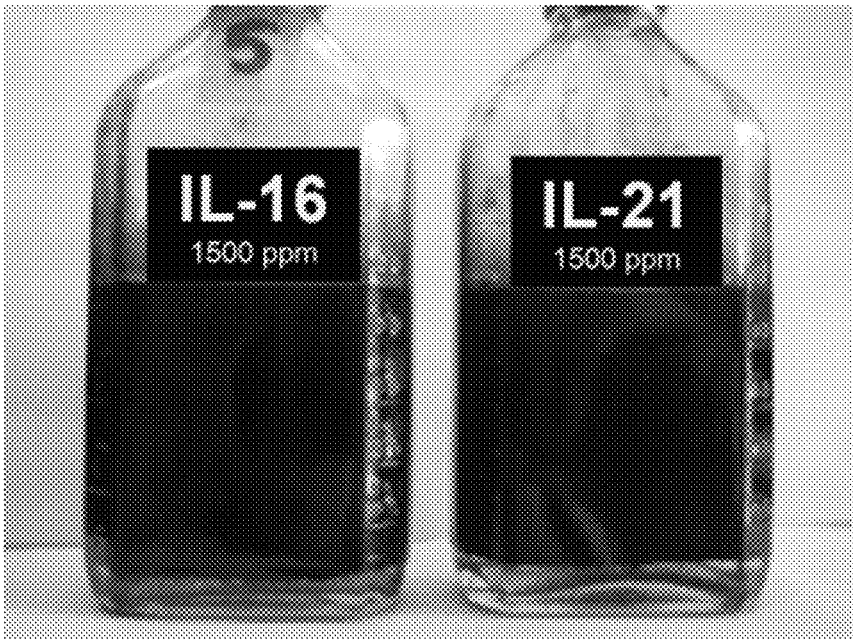

FIG. 6. Photograph showing that ionic liquids IL-16 (trioctylmethylammonium ethylsulfate) and IL-21 (trioctylmethylammonium chloride) break perfectly the water in emulsion M+T crude oil (API=17.1) at 80° C.

Figure 7:
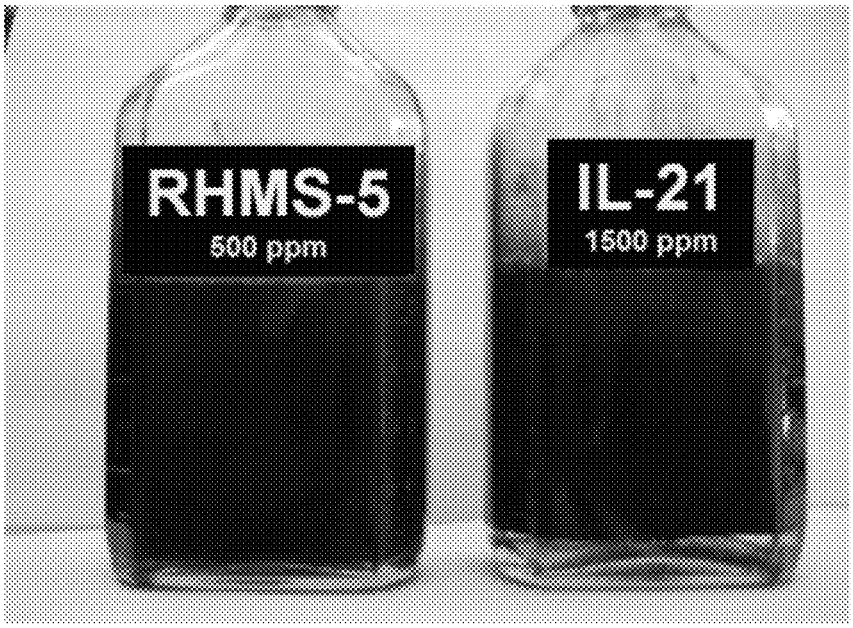

FIG. 7. Photograph showing the breakdown of water/oil emulsion M+T crude oil (API=17.1) caused by the formulation IMP-RHS-5 and the ionic liquid IL-21 at 80° C.

Figure 8:
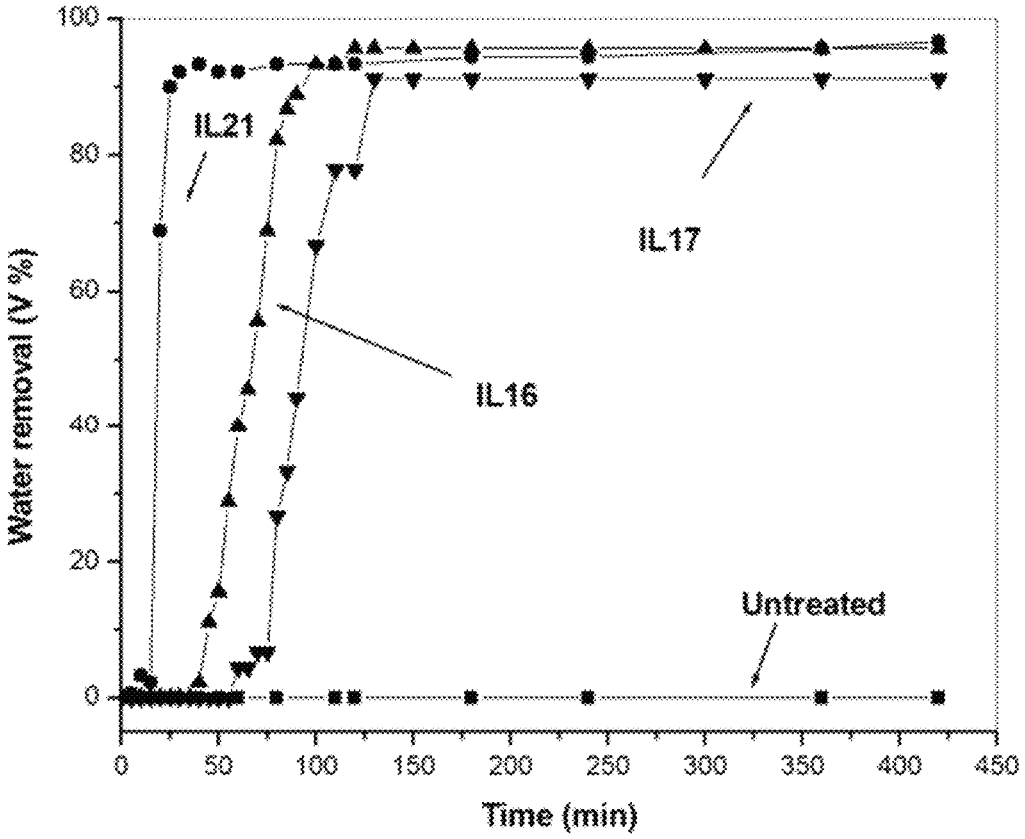

FIG. 8. Graph showing that IL's 16, 17 and 21, break efficient the emulsion water/oil in Bacab crude oil (API=9.2) at 80° C., when additive to 1500 ppm.

Figure 9:
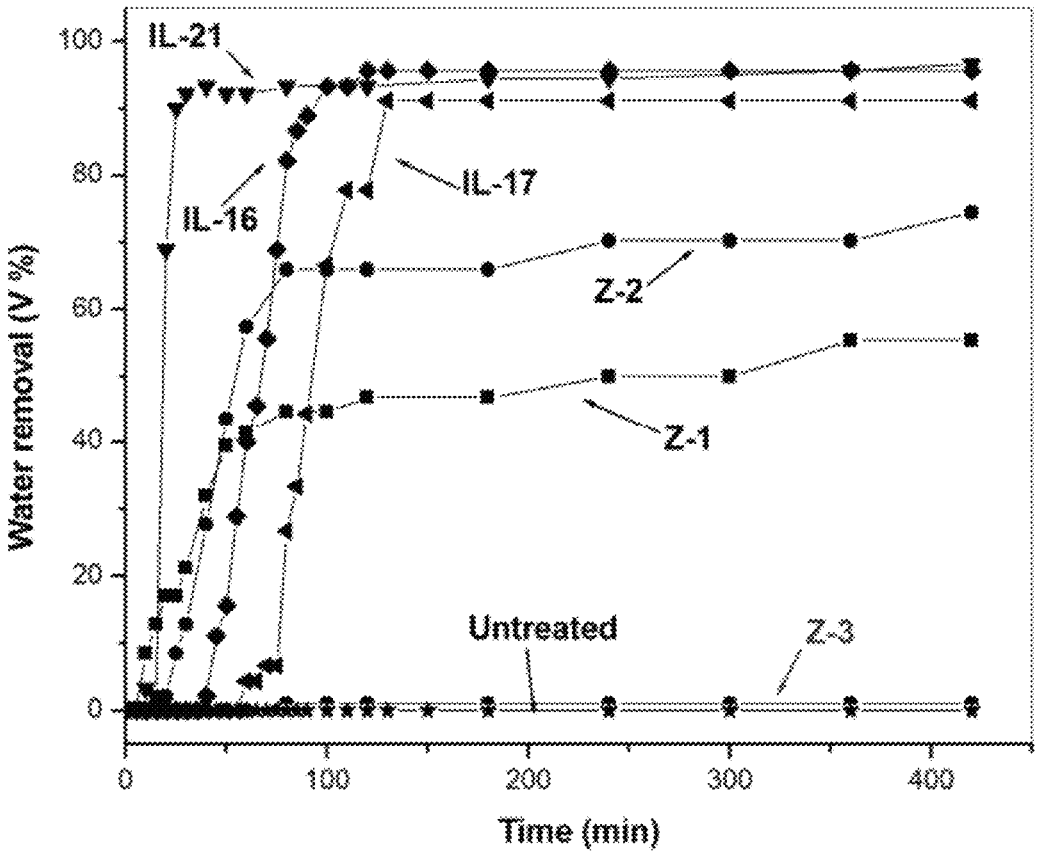

FIG. 9. Graph showing that IL's 16, 17 and 21, break efficient the emulsion water/oil in Bacab crude oil (API=9.2) at 80° C., when additive to 1500 ppm; and commercial copolymers Z-1, 2 and 3 at 1000 ppm.

Figure 10:
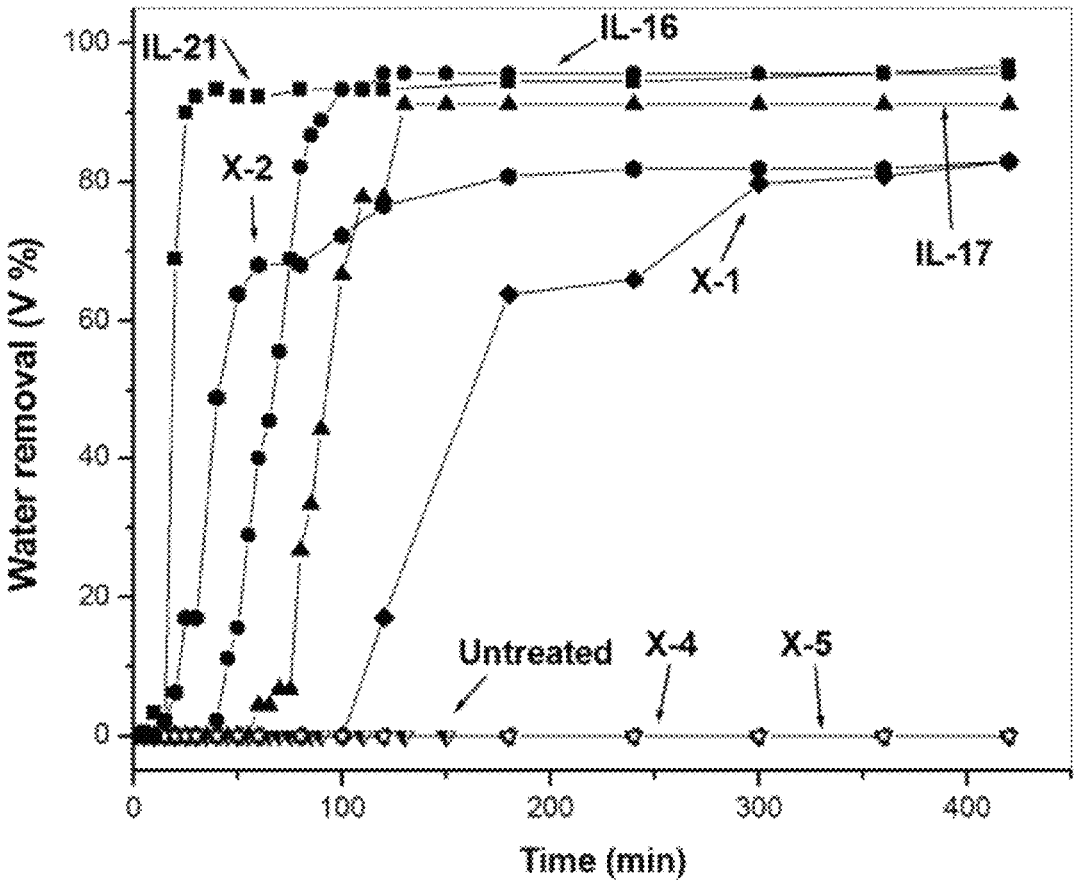

FIG. 10. Graph showing that IL's 16, 17 and 21, break efficient the emulsion water/oil in Bacab crude oil (API=9.2) at 80° C., when additive to 1500 ppm; and commercial copolymers X-1, 2, 4 and 5 at 1000 ppm.

Figure 11:
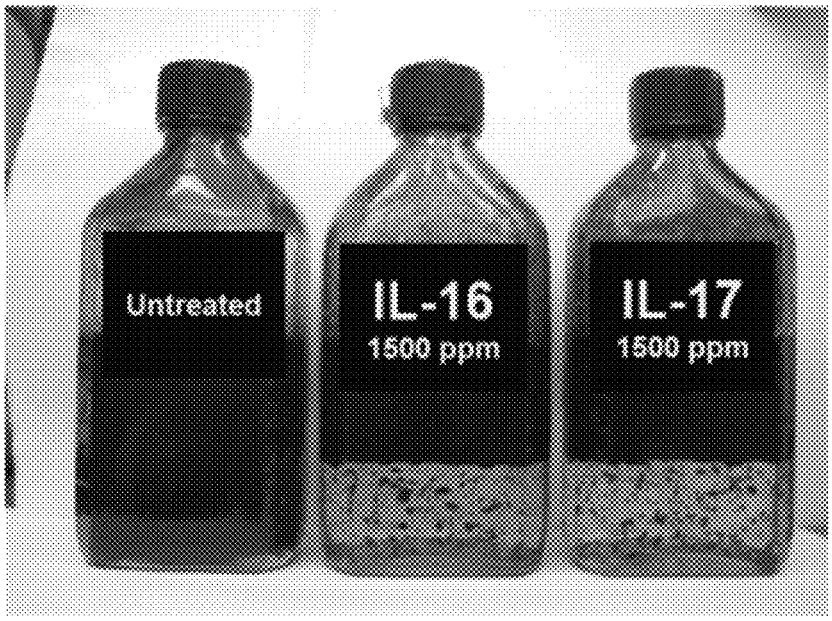

FIG. 11. Photograph showing the perfect breakdown of the emulsion water/oil of Bacab crude oil (API=9.2) at 80° C., caused by IL's 16 and 17, when additive at 1500 ppm.

Figure 12:
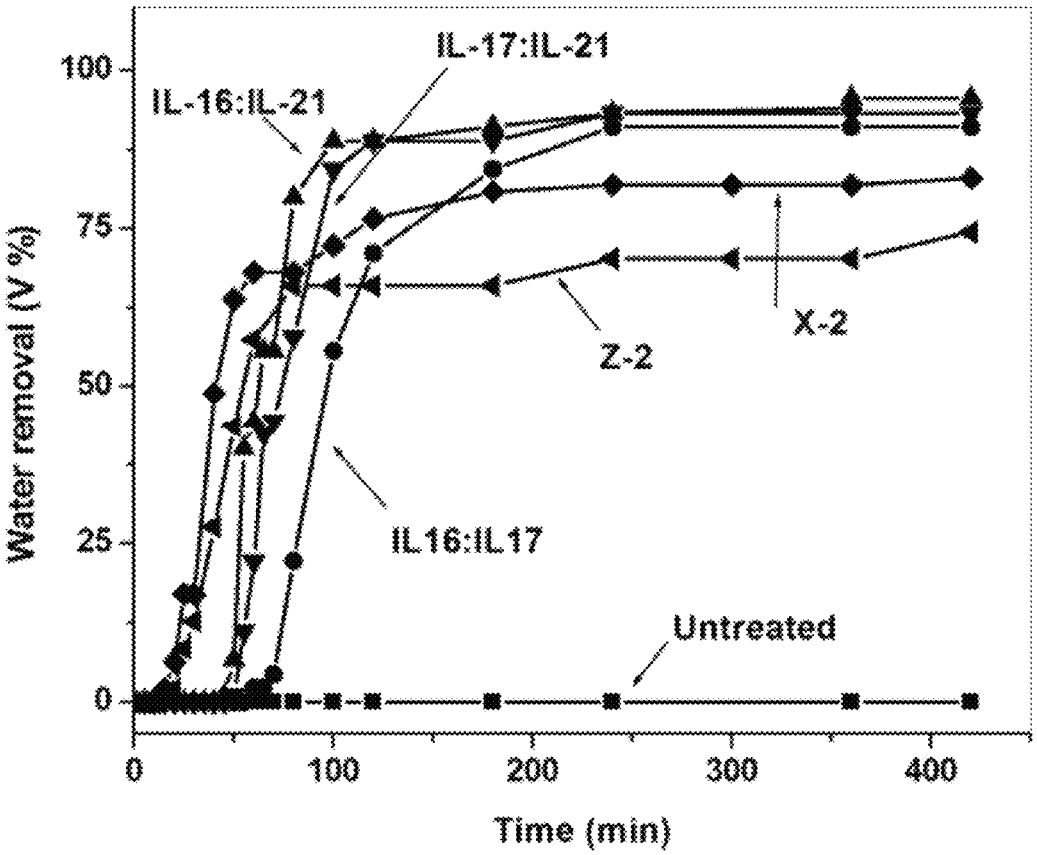

FIG. 12. Graph showing breakdown of the emulsion water/oil of Bacab crude oil (API=9.2) at 80° C., caused by IL's 16, 17 and 21 formulated at 500/500 ppm; and the commercial copolymer X-2 and Z-2 at 1000 ppm.

DETAILED DESCRIPTION OF THE INVENTION

The present invention relates to the application of different families of IL's and their formulations in the demulsification of median, heavy and extra-heavy crude oils which API gravities are within the range of 8 to 30.

The invention is directed to the use of ionic liquids dissolved in solvents having a boiling point in the range from 35° C. to 200° C., preferably dichloromethane, chloroform, methanol, isopropanol, ethanol, benzene, toluene and xylenes, individually or in mixtures of them; when they are used in concentrations from 50 ppm to 2000 ppm, preferably from 600 ppm until 1750 ppm, even more preferably from 750 ppm to 1500 ppm, to break water in oil emulsions and simultaneously desalt crude oils having and API gravity between 30 and 8°.

The invention is directed to the use of formulations consisting of ionic liquids dissolved in solvents having a boiling point in the range from 35° C. to 200° C., preferably dichloromethane, chloroform, methanol, isopropanol, ethanol, benzene, toluene and xylenes, individually or in mixtures of them; when they are used at concentrations of 50 ppm until 5000 ppm, preferably from 600 ppm to 1750 ppm, even more preferably from 750 ppm to 1500 ppm; to break water in oil emulsions and simultaneously desalt crude oils having an API gravity between 20 and 8°.

The IL's whose use as demulsifiers and dehydrating claimed in this invention were synthesized, purified and characterized by spectroscopic techniques such as infrared, NMR (1H and 13C) and mass spectrometry, according to the methods described in the literature: Martinez R, et al (2010), Flores E A, et al (2009), Tao G H, et al (2005); Himmler S et al (2006).

The IL's used in the present invention have general formula $C^+ A^-$, where $C^+$ is an organic cation represented by 1,5-dicarboxy-pentan-2-ammonium, imidazolium, pyridinium, isoquinolinium, ammonium and carboxymethane-ammonium; and $A^-$ is an organic anion, as given in Table 1.

TABLE 1

General structure of cations and anions that constitute the IL's whose application as demulsifiers is claimed in the present invention.

$C^+$ (Cations)

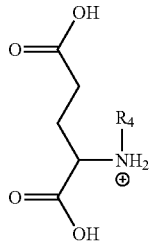

1,5-dicarboxy-pentan-2-ammonium

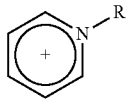

Pyridinium

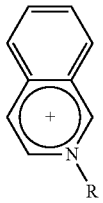

Isoquinolinium

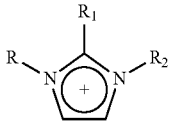

Imidazolium

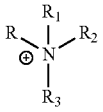

Ammonium

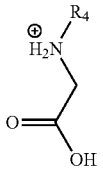

Carboxymethane-ammonium where: R, $R_1$, $R_2$ y $R_3$ are independent radicals represented by alkyl, cycloalkyl, benzyl, alkenyl or alkyl functionalized chains, between 1 and 10 carbon atoms; $R_4$ is hydrogen $A^-$ (Anions)

$R_5COO^-$, $Cl^-$, $Br^-$, $[BF_4]^-$, $[PF_6]^-$, $[SbF_6]^-$, $[R_6SO_4]^-$, $[OTs]^-$, $[OMs]^-$, where $R_5$ is represented by alkyl, cycloalkyl, benzyl, alkenyl or alkyl functionalized chains, included between 1 and 18 carbon atoms; $R_6$ is represented by methyl and ethyl.

Following is described the characterization of the evaluated crude oils in the present invention with the IL's described above:

TABLE 2

Physicochemical characterization of the evaluated crude oils.

| TEST | METHOD | UNITS | RESULTS Median MAYA | Heavy TEKEL | Heavy M + T* | Extra-heavy BACAB |
|---|---|---|---|---|---|---|
| API gravity | ASTM-D-287 | API | 19.12 | 14.84 | 17.1 | 9.2 |
| Salt Content | ASTM-D3230 | lbs/1000 bls | 2958** | 61.72** | 2600** | 8825** |
| Paraffin content | UOP46 | Weight % | 7.56 | 2.12 | 4.57 | 4.24 |
| Water distillation | ASTM-D-4006 | Vol % | 10.0 | 2.0 | 10.0 | 45 |
| Kinematic Viscosity | ASTM-D-445 | $mm^2/s$ | 276.8 | 1783.35 | 777.1 | 22660.3 |
| Pour Point | ASTM-D-97 | ° C. | −24 | *** | −33 | +6 |
| n-heptane insoluble | ASTM-D-3279 | Weight % | 9.86 | 20.45 | 11.85 | 10.4 |
| Saturated | ASTM-D-2007-91 | Weight % | 38.63 | 29.30 | 34.33 | 32.0 |
| Aromatics | ASTM-D-2007-91 | Weight % | 21.44 | 21.46 | 20.42 | 22.8 |
| Resins | ASTM-D-2007-91 | Weight % | 28.23 | 25.15 | 31.72 | 28.0 |
| Asphaltenes | ASTM-D-2007-91 | Weight % | 11.70 | 24.09 | 13.53 | 17.2 |

*This crude oil was prepared by mixing 6 volumes of Maya crude oil and 1 volume of Tekel crude oil.
**Values outside of method, because it only allows to measure values up to 150, were made dilutions for these values.
*** Sample very heavy, outside of method.

Evaluation of IL's Independently and Formulated, Such as Demulsifier and Desalting Agents in Median, Heavy and Extra-Heavy Crude Oils Different concentrated solutions of each of the IL's were prepared, from 5 to 40% by weight, using solvents with boiling point falls in the range of 35 to 200° C., preferably dichloromethane, methanol, ethanol, isopropanol, chloroform, benzene, toluene, xylene, turbosine, naphtha, individually or in mixtures of them, so they added small volumes of the dissolution and was avoided that the effect of the solvent influenced in the breakdown of the emulsion. The IL's were evaluated in concentrations falling within the range of 100 to 2000 ppm.

The IL's were evaluated simultaneously by way of comparison with commercial formulations of the base type of propylene oxide and ethylene oxide, as demulsifier and desalting agents, Table 3 describes the determination of molecular weights (GPC) of the commercial copolymers.

TABLE 3

Characterization of commercial copolymers (GPC).

| Commercial Copolymers | GPC Mn | Mw |
|---|---|---|
| X-Company | | |
| X-1 | 3,085 | 3,282 |
| X-2 | 8,862 | 9,331 |
| X-3 | 3,344 | 3,528 |
| X-4 | 10,945 | 11,904 |
| X-5 | 8,592 | 9,345 |

TABLE 3-continued

Characterization of commercial copolymers (GPC).

| Commercial Copolymers | GPC Mn | Mw |
|---|---|---|
| Z-Company | | |
| Z-1 | 2,905 | 3,105 |
| Z-2 | 6,557 | 6,950 |
| Z-3 | 6,660 | 7,060 |
| Z-4 | 2,297 | 2,527 |
| Z-5 | 2,200 | 2,332 |

The evaluated procedure is described below: the number of oblong bottles provided with insert and lid was indicated by the number of compounds to evaluate, over an additional which corresponds to the crude oil without additive; in each one of them was added crude oil to the 100 mL mark. All the bottles were placed in a bath of water at a controlled temperature in 80° C. for 20 minutes, at the end of that time was added the aliquot part of the dissolution of the IL's (individual or formulations) and formulations of commercial copolymers mentioned above; all the bottles were agitated during 3 minutes at a rate of 2 shots per second. After being purged were placed new account in the temperature-controlled bath and the breaking of emulsion water in oil was successively read in the following way: every 5 minutes during the first 60 minutes, every 10 minutes during the second hour, and finally every hour until the end of the test. All the IL's a matter of this invention and commercial formulations were evaluated at different including concentrations in the range 100 to 2000 ppm.

By way of demonstration, which does not imply any limitation, are shown in the following figures, the graphical results of the evaluation described above, for different concentrations of both individual and formulated IL's.

Evaluation in Median Crude Oil

FIG. 1 shows that the IL-05 after 80 minutes and a concentration of 500 ppm shows the greater water removal in Maya crude oil, compared to 1500 to 2000 ppm. At the time of 80 minutes is achieved 85% of water removal; at 180 minutes is reached 92% and from 240 minutes 95%.

In the FIG. 2 is showed that IL-21 efficiently removes the water of the Maya crude oil in the interval of concentrations included between 1500 and 2000 ppm. At 25 minutes, both concentrations remove the water in a 50%, starting from that time the concentration of 2000 ppm showed the best performance in the removal of water reaching 95% in 180 minutes, however later is observed that the emulsion is formed again. On the other hand, the concentration of 1500 ppm always shows to a tendency to the rise in the removal of water, achieving 95% to the 360 minutes.

TABLE 4

Efficiency of dehydrated and desalted in Maya Crude (API = 19.1).

| | IL-05 (ppm) | | | IL-21 (ppm) | | | |
|---|---|---|---|---|---|---|---|
| | 500 | 1500 | 2000 | 500 | 1000 | 1500 | 2000 |
| % Desalted | 69 | 67 | 64 | 55 | 68 | 76 | 72 |
| % Dehydrated (7 h) | 95 | 90 | 90 | 80 | 88 | 95 | 90 |

In Table 4, the values for the efficiency in the dehydrated and desalted after of the treatment with IL's are shown (to see FIGS. 1 and 2).

For the IL-06 the values of desalted are very similar although the greater proportion of removed water was obtained with the concentration of 500 ppm. On the other hand, the IL-21 obtained the greater water removal with the concentrations of 1500 and 2000 ppm, however the greater proportion of desalted was obtained with the concentration of 1500 ppm, being also this concentration the one that desalted with greater effectiveness to the Mayan crude.

In addition, in FIG. 3 it is observed that IL's 05 and 21 break the water/oil emulsion perfectly, because the aspect of the watery phase is clear, is transparent and clots neither thread are not observed, that is to say the interphase is very well defined.

Evaluation in Heavy Crude Oil

With the purpose that the investigation developed in this invention is even more useful to the national system of refineries, we proceeded to evaluate the IL's in crude even heavier (smaller API gravity). For this purpose, it is prepared a crude denominated M+T (API=17.1) starting from the combination of 6 volumes of Mayan crude oil (API=19.1) and 1 volume of Tekel crude oil (API=14.84). The evaluation also included the comparison with two commercial products, one of them is a triblock copolymer of polypropylene oxide—polyethylene oxide of the Company Z (Z-1) (Mn=2900 and I=1.07) and the other one is a formulation property of the IMP (RHS-5). The results are shown in the following graphics.

The IL's 6, 16, 17 and 21 break with greater efficiency the emulsion water-oil when compares with IMP formulation and the commercial copolymer; the IL-21 obtained the major efficiency (90%) to the 240 minutes. These results are shown in the FIG. 4.

Next the values obtained in the desalted stage are compared with the treatment realized by the IL's and with commercial products.

TABLE 5

Efficiency in the dehydrated and desalted of crude M + T (API = 17.1)

| | IL's (1500 ppm) | | | | (500 ppm) | |
|---|---|---|---|---|---|---|
| | 6 | 16 | 17 | 21 | Z-1 | IMP-RHS-5 |
| % Desalted | 28 | 42 | 35 | 71 | 12 | 18 |
| % Dehydrated (7 h) | 40 | 70 | 50 | 90 | 20 | 30 |

In FIGS. 5, 6 and 7, it is observed clearly that IL's 16, 17 and 21 breaks the emulsion water-oil present in heavy crude, because the corresponding interphases are well defined, also the presence of clots and thread are not observed; particularly, in FIG. 7 the formulation IMP-RHS-5 does not break the emulsion, therefore and considering all before exposed, it is possible to affirm that the IL's before mentioned overcome in dehydrating and desalinating efficiency to the formulations commercial and of the IMP.

So far it is observed that is greater drying efficiency and therefore the efficiency of desalination of IL's compared to commercial copolymer and the formulation of IMP, which consists of breakers, coalescing and clarifiers agents of the emulsion Evaluation in Extra-Heavy Crude Oil Continuing the ILs application, they were evaluated in a heavier crude oil (API=9.2); results are shown in the following graphs:

The water removal efficiency of IL's 16, 17, and 21, at a concentration of 1500 ppm is reported in FIG. 8; it could be observed that the ionic liquid IL-21 removes 90% of water in less than one hour, this efficiency is greater than those of IL-16 and IL-17, because they require two hours for removing the same amount of water.

A comparative study of the dehydrating and desalting efficiencies of the ionic liquids 16, 17 and 21 and some commercial copolymers of X and Z companies (x and Z copolymers respectively).

It may be easily observed in FIG. 9 that IL's 16, 17 and 21 (1500 ppm) break an emulsion faster than commercial copolymers Z-1, 2 and 3 (1000 ppm); although IL's are employed at a greater concentration, their efficiencies justify them, as the best copolymer, Z-2, reach just 70% of water removal.

A similar behavior is observed in FIG. 10, that is to say, IL's show better performance that those of commercial copolymers, now from X company; best of them reached an efficiency of 80%, lower than those of IL's yield.

TABLE 6

Dehydrating and desalting efficiency in crude oil Bacab (API = 9.2)

| | IL's | | | Z Company | | X Company | |
|---|---|---|---|---|---|---|---|
| | 16 | 17 | 21 | Z-1 | Z-2 | X-1 | X-2 |
| % Desalted | 42 | 35 | 71 | 30 | 40 | 60 | 55 |
| % Dehydrated (7 h) | 70 | 50 | 90 | 50 | 70 | 80 | 80 |

In the Table 6 are summarized the percentages of desalting and dewatering of IL's 16, 17 and 21, compared to those of commercial copolymers provided by Z and X companies; it is clear that the performance of the IL's are better in both aspects.

FIG. 11 shows bottles which show that water-oil interfaces are well defined after the application of IL's 16 and 17 over an extra-heavy crude oil (9.2 API), however some lumps are observed on the bottle wall.

Different formulations were obtained from combinations of IL's 16, 17 and 21 at different compositions; the performance of these formulations is reported in FIG. 12 and it can be observed that at a total concentration of 1000 ppm (500 ppm of each ionic liquid) there was a water removal of 90% before 120 minutes.

In FIG. 12 is showed the synergy between IL's when they are combined in formulations, at 1000 ppm (total concentration) the performance reached in dewatering is 90%, similar value obtained by IL's when they were evaluated at 1500 ppm in independent way, as it is reported in FIG. 14.

It is also important to remark that formulations, which performance is reported in FIG. 12, remove water more efficiently that commercial copolymers Z-2 and X-2.

TABLE 7

Dehydrating and desalting efficiencies in Bacab crude oil (API = 9.2)

| | Formulations of ILs 500 ppm/500 ppm | | | Commercial formulations 1000 ppm | |
|---|---|---|---|---|---|
| | IL16-IL21 | IL17-IL21 | IL16-IL17 | Z-2 | X-2 |
| (%) Desalted | 66 | 71 | 65 | 55 | 59 |
| (%) Dehydrated (7 h) | 92 | 90 | 89 | 74 | 83 |

Finally, it may be observed in Table 7 that the dehydrating and desalting efficiencies of IL's are greater than those of formulations prepared with commercial products from X and Z companies.

BIBLIOGRAPHY

Al-Sabagh A M, Badawi A M and Noor EI-Den M. R. (2002) Breaking water-in-crude-oil emulsion by novel demulsifiers based on maleic anhydride-oleic acid aduct. *Pet. Sci. Technol.* 20 887-914.

Canter N. (2007) Using dicationic liquids as high temperature lubricants *Tribology & Lubrication Technology* 63 5

Collins I R, Earle M J, Exton S P, Plechkova N V and Seddon K R (2006) Ionic Liquids and uses thereof. WO 2006/111712 A2.

Eβer J, Wasserscheid P and Jess A. (2004) Deep desulfurization of oil refinery streams by extraction with ionic liquids. *Green Chem.* 6 316-322.

Flores E A, Martínez R, Guzmán D J y Likhanova N V. Líquidos iónicos como reductores de viscosidad en crudos pesados. Solicitud de patente mexicana MX/a/2009/007078.

Guzmán Lucero D J, Flores P, Rojo T, Martínez-Palou R. (2010) Ionic liquids as demulsifiers of wáter-in-crude oil emulsions: study of the microwave effect. *Energy Fuels* 24 3610-3615, DOI:10.1021. Publicado en la web 05/17/2010.

Hellberg P E and Uneback I. (2007) WO/115980 Environmentally-friendly oil/water demulsifiers.

Himmler S, Hormann S, van Hal R, Schulz P S and Wasserscheid P. (2006) Transesterification of methylsulfate and ethylsulfate ionic liquids-an environmentally benign way to synthesize long-chain and functionalized alkylsulfate ionic liquids. *Green Chem.* 8 887-894

Martínez R, Likhanova N V, Flores E A and Guzmán D J. Halogen-free ionic liquid in naphtha desulfurization and their recovery. US 2010/0051509A1

Myers C, Hatch S R and Johnson D (2006) Phosphoric ester demulsifier composition WO2006/116175 A1

Patel N and Suresh S (2009) Methods for breaking crude oil and water emulsions WO/097061.

Peng G, Zubin C, Dezhi Z, Dandon Li and Shuyan Z. (2005) extraction of basic nitrides from diesel using ionic liquids at room temperature. *Pet. Sci. Tech.* 23 1023-1031.

Rojo Portillo T. Estudio para el aseguramiento de flujo en los sistemas de producción de crudo pesado empleando liquidos iónicos. Tesis UNAM (2009).

Siskin M, Francisco M A and Billimoria R M (2008) Upgrading of heavy hydrocarbons by the separation of asphaltenes using ionic liquids WO/2008/124042 A1

Spinelli L S, Aquino A S, Pires R V, Barboza E M, Louvisse A M T and Lucas E F (2007) Influence of polymer bases on the synergistic effects obtained from mixtures of additives in the petroleum industry: performance and residue formation. *J. Petrol. Sci. Eng.* 58 111-118.

Talingting-Pabalan R, Woodward G, Dahayanake M and Adam H. (2009) Method for separating crude oil emulsions WO/2009/023724.

Tao Gh, He L, Sun N and Kou Y. (2005) New generation ionic liquids: cations derived from amino acids. *Chem. Commun.* 3562-64.

Taylor G N (1997) Demulsifier for water-in-oil emulsions, and method of use U.S. Pat. No. 5,609,794.

Xu X, Yang J and Gao J. (2006) Effects of demulsifier structure on desalting efficiency of crude oil. *Pet. Sci. Technol.* 24 673-688

What is claimed is:

1. A method of breaking water-in-oil emulsion and desalting crude oils comprising:

contacting said crude oils having API gravity between 30 and 8° or water-in-oil emulsion with an ionic liquid in a solvent having a boiling point in the range of 35° C. to 200° C., at a concentration of 50 ppm to 2000 ppm, wherein said ionic liquid has a 1,5-dicarboxy-pentane-2-ammonium or a carboxymethane ammonium cation and an anion selected from the group consisting of $R_5COO^-$, $Cl^-$, $Br^-$, $[BF_4]^-$, $[PF_6]^-$, $[SbF_6]^-$, $[R_6SO_4]^-$, $[OTs]^-$, and $[OMs]^-$, where $R_5$ is alkyl, cycloalkyl, benzyl, alkenyl, aromatic or functionalized alkyl having 1 and 18 carbon atoms, and $R_6$ is methyl or ethyl.

2. The method of claim 1, wherein said solvent is selected from the group consisting of dichloromethane, chloroform, methanol, isopropanol, ethanol, benzene, toluene, xylenes, and mixtures thereof.

3. The method of claim 1, wherein the ionic liquid is included in an amount of 600 ppm to 1750 ppm.

4. The method of claim 1, wherein the ionic liquid is included in an amount of 750 ppm to 1500 ppm.

5. The method of claim 1, wherein said anion of said ionic liquid is $[R_6SO_4]^-$, where $R_6$ is methyl or ethyl.

6. The method of claim 1, wherein said anion is selected from the group consisting of $R_5COO^-$and $R_6SO_4^-$.

7. A method of breaking water-in-oil emulsions and desalting crude oil comprising:

contacting the crude oil having an API gravity between 20 and 8° or water-in-oil emulsion with an ionic liquid formulation in a solvent having a boiling point in the range of 35° C. to 200° C. at a concentration of 50 ppm to 2000 ppm, wherein said ionic liquid is selected from the group consisting of trihexylmethylammonium methylsulfate, trioctylmethylammonium ethyl sulfate, trioctylmethylammonium methylsulfate, and mixtures thereof.

8. The method of claim 7, wherein said solvent is selected from the group consisting of dichloromethane, chloroform, methanol, isopropanol, ethanol, benzene, toluene, xylenes, and mixtures thereof.

9. The method of claim 7, wherein the ionic liquid is included in an amount of 600 ppm to 1750 ppm.

10. The method of claim 7, wherein the ionic liquid is included in an amount of 750 ppm to 1500 ppm.

11. A method of breaking water-in-oil emulsions containing crude oil and desalting the crude oil comprising:

contacting the crude oil having an API gravity between 20 and 8° or water-in-oil emulsion with an ionic liquid formulation in a solvent having a boiling point in the range of 35° C. to 200° C. at a concentration of 50 ppm to 2000 ppm, wherein said ionic liquid is an ionic liquid having a cation selected from the group consisting of ammonium, imidazolium, and pyridinium and an anion selected from the group consisting of $R_5COO^-$and $R_6SO4^-$where $R_5$ is cycloalkyl, benzyl, alkenyl, aromatic or functionalized alkyl having 1 and 18 carbon atoms, and $R_6$ is methyl or ethyl, or an ionic liquid having an isoquinolinium cation and an anion selected from the group consisting of $R_5COO^-$, $Cl^-$, $Br^-$, $[BF_4]^-$, $[PF_6]^{31}$ , $[SbF_6]^-$, $[R_6SO_4]^-$, $[OTs]^-$, and $[OMs]^-$, where $R_5$ is alkyl, cycloalkyl, benzyl, alkenyl, aromatic or functionalized alkyl having 1 and 18 carbon atoms, and $R_6$ is methyl or ethyl.

12. The method of claim 11, wherein said ionic liquid has an anion selected from the group consisting of ethylsulfate and methylsulfate.

13. A method of breaking water-in-oil emulsion and desalting crude oils comprising:

contacting said crude oils having API gravity between 30 and 8° or water-in-oil emulsion with an ionic liquid in a solvent having a boiling point in the range of 35° C. to 200° C., at a concentration of 50 ppm to 2000 ppm, wherein said ionic liquid has an anion selected from the group consisting of ethylsulfate and methylsulfate, and a quaternary ammonium cation having the formula NR, $R_1$, $R_2$, $R_3^+$where R, $R_1$, $R_2$ and $R_3$ are independently an alkyl having 1-10 carbon atoms.

14. A method of breaking water-in-oil emulsions and desalting crude oils, comprising the step of contacting said crude oil having API gravity of 20-8° with an ionic liquid at a concentration of 50 ppm to 2000 ppm, wherein said ionic liquid is in a solvent having a boiling point of 35° -200° C., and where said ionic liquid is selected from the group consisting of a mixture of trioctylmethylammonium methylsulfate and trioctylmethylammonium ethyl sulfate, and a mixture of trioctylmethylammonium ethylsulfate and trioctylmethylammonium chloride.

15. A method of breaking water-in-oil emulsions containing crude oil, comprising the steps of:

contacting the water-in-oil emulsion with an ionic liquid in an amount to break the water- in-oil emulsion, wherein said ionic liquid is selected from the group consisting of trihexylmethyl ammonium methylsulfate, trioctylmethylammonium ethyl sulfate, trioctylmethylammonium methylsulfate, and mixtures thereof.

16. The method of claim 15, wherein said water-in-oil emulsion is a water-in-crude oil emulsion where said crude oil has an API gravity of 20 to 8°.

17. The method of claim 16, further comprising the step of forming a mixture of said ionic liquid in a solvent, and thereafter admixing the resulting mixture with the water-in-oil emulsion, wherein said solvent is selected from the group consisting of dichloromethane, chloroform, methanolisopropanol, ethanol, benzene, toluene, and xylene, and where said mixture includes 5 to 40% by weight of the ionic liquid.

* * * * *